US005820439A

United States Patent [19]

Hair, III

[11] Patent Number: 5,820,439

[45] Date of Patent: Oct. 13, 1998

[54] GYRO STABILIZED REMOTE CONTROLLED TOY MOTORCYCLE

[75] Inventor: James M. Hair, III, San Ramon, Calif.

[73] Assignee: Shoot the Moon Products, Inc., Pleasanton, Calif.

[21] Appl. No.: 789,881

[22] Filed: Jan. 28, 1997

[51] Int. Cl.[6] ..... A63H 1/00; A63H 17/16; A63H 17/36

[52] U.S. Cl. ..... 446/233; 446/440; 446/468

[58] Field of Search ..... 446/440, 468, 446/233, 288

[56] References Cited

U.S. PATENT DOCUMENTS

| | | | |
|---|---|---|---|
| Re. 30,299 | 6/1980 | Greenwood . | |
| 1,073,880 | 9/1913 | Voltz | 446/233 |
| 1,513,143 | 10/1924 | Welch et al. . | |
| 2,829,467 | 4/1958 | Pagano . | |
| 3,373,832 | 3/1968 | Summers | 446/440 |
| 3,465,840 | 9/1969 | Summers | 446/440 |
| 3,546,814 | 12/1970 | Melendez . | |
| 3,650,067 | 3/1972 | Greenwood . | |
| 3,772,824 | 11/1973 | Terzian et al. | 446/440 |
| 4,200,168 | 4/1980 | Moog | 180/282 |
| 4,267,663 | 5/1981 | Nagahara . | |
| 4,290,228 | 9/1981 | Goldfarb et al. . | |
| 4,309,841 | 1/1982 | Asano . | |
| 4,342,175 | 8/1982 | Cernansky et al. . | |
| 4,383,388 | 5/1983 | Suimon . | |
| 4,387,532 | 6/1983 | Suimon . | |
| 4,601,674 | 7/1986 | Koizumi . | |
| 4,902,271 | 2/1990 | Yoneda . | |
| 4,966,569 | 10/1990 | Asano | 446/440 |
| 5,256,942 | 10/1993 | Wood | 318/649 |
| 5,368,516 | 11/1994 | Hoeting et al. . | |

*Primary Examiner*—Robert A. Hafer
*Assistant Examiner*—Laura Fossum
*Attorney, Agent, or Firm*—Blakely, Sokoloff, Taylor & Zafman LLP

[57] ABSTRACT

Gyro stabilized remote controlled toy motorcycle having good stability and controllability without using ground contacting auxiliary wheels or the like. The motorcycle comprises a chassis supporting a fixed angle rear wheel drive and associated motor and a castered front wheel. A gyro wheel having an axis nominally parallel to the axis of the rear wheel is mounted in a gimbal with a vertical axis in the forward part of the chassis and connected to the front wheel fork and post to turn the front wheel responsive to the rotation of the gimbal relative to the chassis. The chassis further includes a radio receiver, battery power and a steering device, such as a motor and slip clutch for torquing the gyro wheel gimbal. To turn in a first direction the gyro gimbal is torqued in the opposite direction, initially causing the front wheel to also turn in the opposite direction. As the motorcycle and the gyro lean into the turn, a correcting torque is generated by the gyro and caster of the front wheel, overcoming the initial steering torque to maintain the proper steering angle and balance for the motorcycle. Various embodiments are disclosed.

25 Claims, 3 Drawing Sheets

GYRO STABILIZED REMOTE CONTROLLED TOY MOTORCYCLE

BACKGROUND OF THE INVENTION

1. Field of the Invention

The present invention relates to the field of toy radio controlled two wheel vehicles such as toy radio controlled motorcycles.

2. Prior Art

Various types of gyro stabilized two wheel toys and radio controlled two wheel toys are well known in the prior art. By way of example, in U.S. Pat. No. 1,513,143, a gyroscopic controlled wheeled toy is disclosed wherein a gyro wheel has an axis nominally parallel to the axis of a fixed rear wheel, with a vertical gimbal axis coupled to a castered front wheel of the vehicle so that the gyro wheel will stabilize the vehicle in its direction of travel. Nominally, the gyro wheel will stabilize the vehicle for straightforward motion, though it is said that changing the length of linkage between the gimbal and the steerable front wheel will vary the course followed by the vehicle. In U.S. Pat. No. 4,342,175, a radio controlled motorcycle is controlled by shifting weights sideways on the vehicle to induce or eliminate turns. In U.S. Pat. No. 4,290,228, controllable outriggers are used to provide toy vehicles with automatic banking, the outriggers preventing the vehicle from falling over when the vehicle balance itself would not prevent the same.

The use of outriggers can be effective in providing stability for the vehicle, though outriggers are not suitable for use on rough surfaces, such as parking lots, driveways, sidewalks and the like because of the need for a substantially flat surface to prevent the outriggers from catching on high spots and/or holding the vehicle off the ground to prevent traction by the rear drive wheel. Controlling steering by shifting weights solves this problem, though the stability of the resulting vehicle is speed dependent, the vehicle having a tendency to fall over at low speeds. The addition of a gyro wheel for stability purposes solves the low speed stability problem, though heretofore the inventor is unaware of any gyro stabilized two wheel vehicles which include a radio controlled steering capability.

SUMMARY OF THE INVENTION

Gyro stabilized remote controlled toy motorcycle having good stability and controllability without using ground contacting auxiliary wheels or the like. The motorcycle comprises a chassis supporting a fixed angle rear wheel drive and associated motor and a castered front wheel. A gyro wheel having an axis nominally parallel to the axis of the rear wheel is mounted in a gimbal with a vertical axis in the forward part of the chassis and connected to the front wheel fork and post to turn the front wheel responsive to the rotation of the gimbal relative to the chassis. The chassis further includes a radio receiver, battery power and a steering device, such as a motor and slip clutch for torquing the gyro wheel gimbal.

To turn in a first direction, the gyro gimbal is torqued in the opposite direction, initially causing the front wheel to also turn in the opposite direction. This causes the chassis of the motorcycle to lean in the direction of the desired turn. The characteristics of the motorcycle in a turn depends on the selection of the relevant parameters used, such as the gyro wheel momentum, the weight of the motorcycle and the height of the center of gravity of the motorcycle, the amount of caster of the front wheel and the torque applied in the turn, if any. As the motorcycle and the gyro lean into the turn, a correcting torque is generated by the gyro and caster of the front wheel. Once in a turn, the gyro will stabilize the motorcycle at whatever steering radius the motorcycle is in. With one selection of parameters, the motorcycle will stabilize in the turn so long as the steering torque is applied, and automatically right itself when the steering torque is removed. With another selection of parameters, the motorcycle will stabilize in a turn after the steering torque has been applied to establish the turn and then removed. In this case, applying torque to the gyro again will either straighten the motorcycle to terminate the turn, or will cause the motorcycle to lean further into the turn, depending upon the direction of the torque provided. In either case, increasing the speed of the motorcycle will increase the turning radius and decreasing the speed will decrease the turning radius.

DETAILED DESCRIPTION OF THE PRESENT INVENTION

Figure 1:
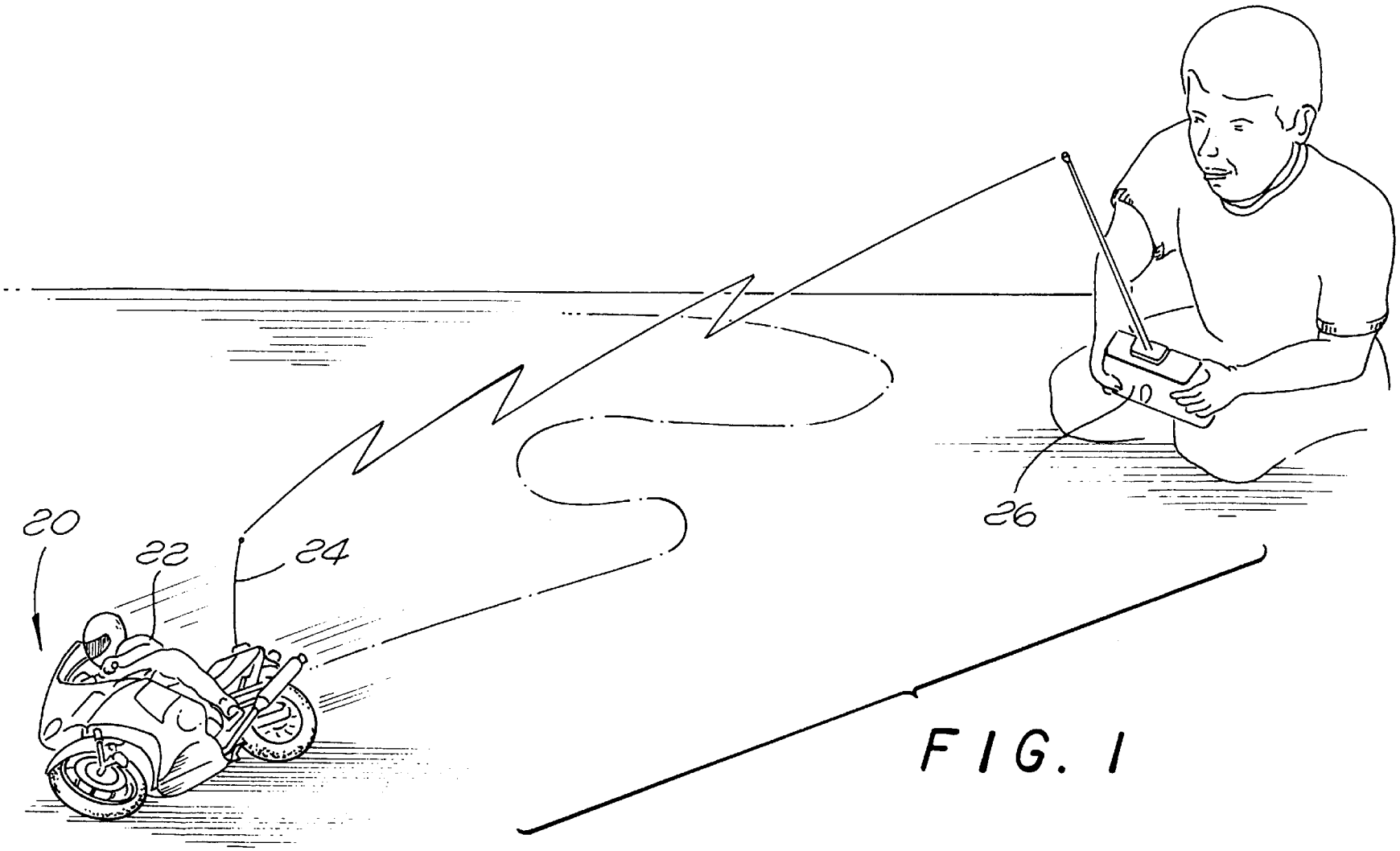
FIG. 1 is a view of the preferred embodiment of the gyro-stabilized, remote-controlled toy motorcycle of the present invention.

First referring to FIG. 1, a view of the preferred embodiment of the gyro-stabilized, remote-controlled toy motorcycle of the present invention may be seen. The motorcycle, generally indicated by the numeral 20, is aesthetically configured to look like a modern high performance motorcycle with a rider 22 and an aerial 24 for receiving remote-control radio signals from a user-operated controller 26. The radio control may be of conventional design, such as of the type used for other radio-controlled model vehicles and aircraft, in the preferred embodiment including steering controls and speed controls. In one embodiment disclosed herein, the steering control is a three-position control, straight ahead, left turn and right turn. In this case, the radius of the turn will depend upon the current speed of the motorcycle, a commanded turn having a larger turning radius the faster the motorcycle is moving. However, if desired, proportional control of the turning may readily be provided, as subsequently described herein. Also, the speed control itself may be proportional control or a selection between two or more discrete speeds, as desired.

One of the characteristics of the radio-controlled toy motorcycle of the present invention is the absence of any outrigger-type wheels or skids of any kind to keep the motorcycle from falling over when in operation. Instead, the same is gyro-stabilized in a manner to be described so as to provide excellent stability at substantially any speed, whether operating in a straight forward direction or negotiating a turn.

Figure 2:
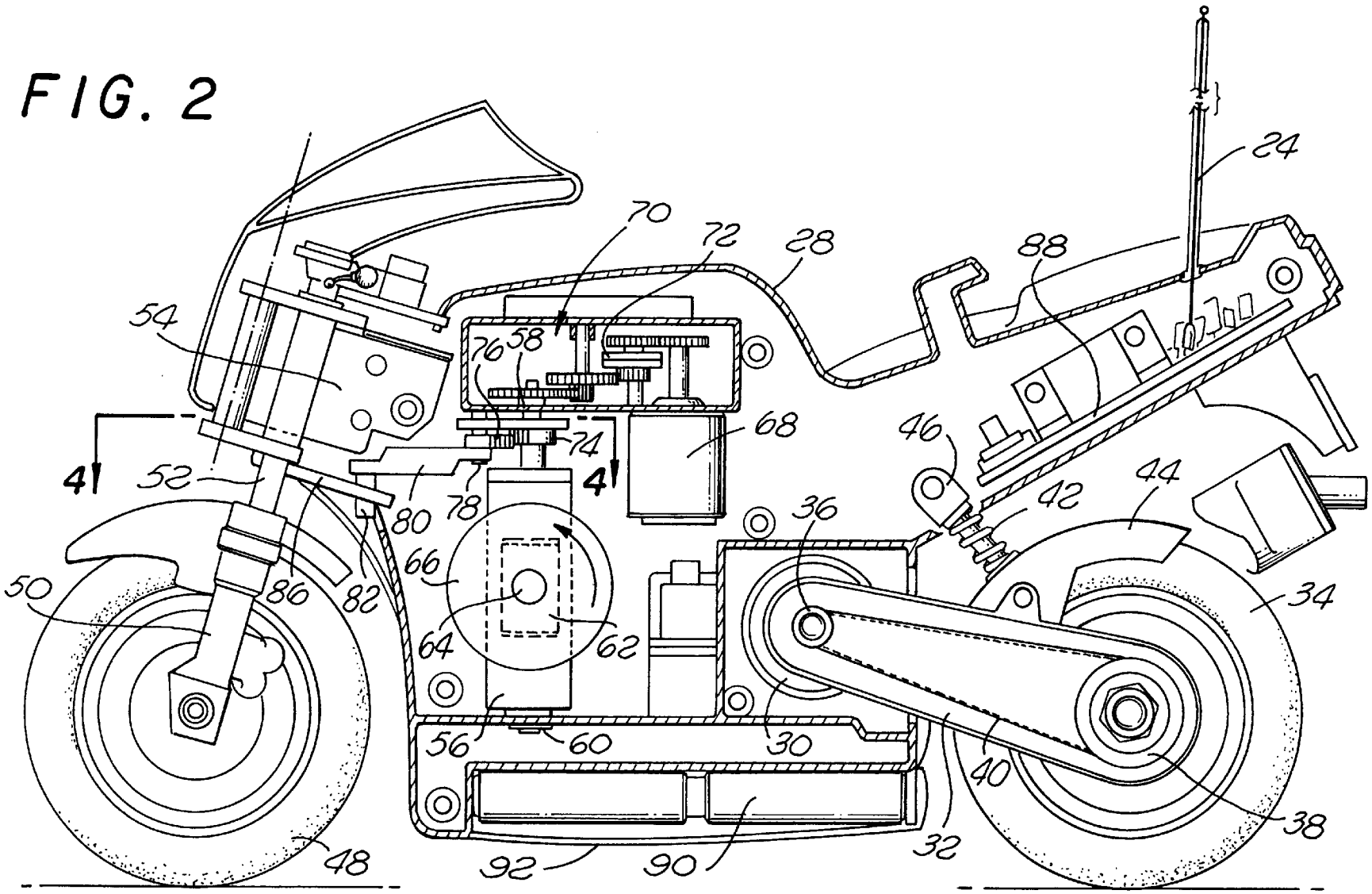
FIG. 2 is a partial cross section of the toy motorcycle of FIG. 1 showing the major components thereof.

Now referring to FIG. 2, a partial cross section of the toy motorcycle of FIG. 1, showing the major components thereof, may be seen. The motorcycle is characterized by left and right shell-type chassis members 28, housing various components of the motorcycle and supporting other components thereof. In particular, the chassis members 28, only one of which is visible in FIG. 2, support a first motor 30, together with a swing arm assembly 32 supporting the rear wheel 34 and mounted for swinging about the axis of the drive shaft of the motor 30. In the embodiment shown, a pulley 36 on the motor drives a pulley 38 on the rear wheel through a drive belt 40, the pulleys and drive belt being generally enclosed with the hollow swing arm 32. The entire swing arm and rear wheel assembly is spring mounted to the chassis by spring 42 pushing against a rear fender 44 supported from the swing arm 32, the spring being confined and supported by coil spring support member 46. Obviously in other embodiments, other drive mechanisms, such as gear drives and the like, may be used as desired.

At the front of the motorcycle, the front wheel 48 is supported for rotation on fork 50, which is integrally coupled to steering post 52 and supported for rotation about the steering post axis 52 by steering post support 54, supported from the chassis members 28. It will be noted that steering post 52 is inclined in an aft direction in the preferred embodiment, preferably in the range of approximately 17 to 20 degrees, and that the axis of the steering post approximately passes through the axis of the front wheel to give the front wheel a caster affect, tending to turn the front wheel in the direction the motorcycle is leaning to encourage the motorcycle toward an upright position when in motion.

Also mounted to the chassis members 28 is a gimbal assembly 56, supported from above and below by gimbal bearings 58 and 60 for rotational movement about a vertical axis. The gimbal assembly supports a second motor 62, visible in phantom in FIG. 2, having in this embodiment a through shaft 64 with a flywheel-like member 66 on each end of the shaft. These flywheel-like members, when spinning, provide a gyroscopic affect, the use of which shall be subsequently described.

Also supported from the chassis members 28 is a third motor 68 driving a gear train, generally indicated by the numeral 70, through a slip clutch 72. The slip clutch limits the torque which may be provided through the gear train, the gear train itself torquing the gimbal assembly 56 about its vertical rotational axis. The torquer in the preferred embodiment is a conventional DC motor with a centrifugal-type slip clutch which, when the motor is off, provides no friction between the driving centrifugal clutch member and the driven member, as the centrifugal members elastically withdraw from contact with the driven member whenever the motor is not on.

Figure 3:
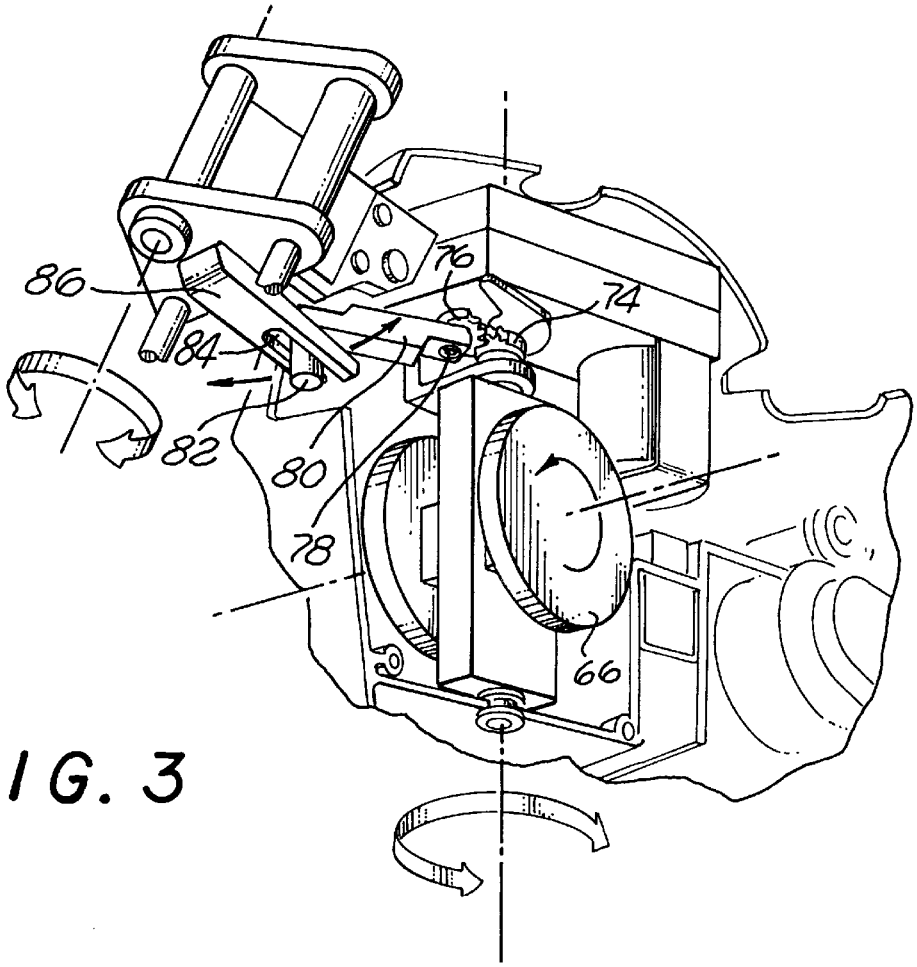
FIG. 3 is a perspective view looking upward at the gimbal and steering assemblies of the preferred embodiment of the present invention.
Figure 4:
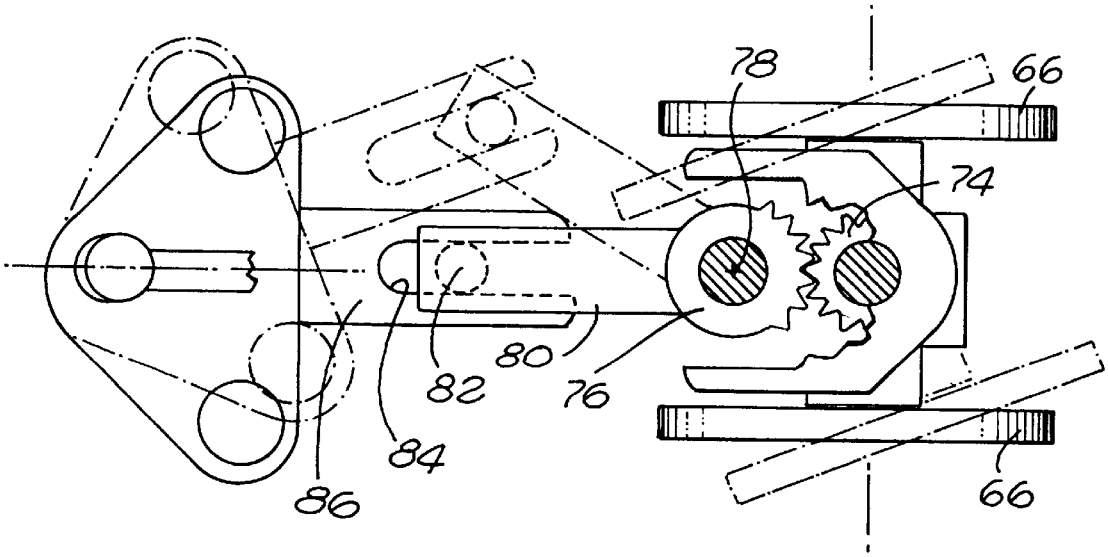
FIG. 4 is a schematic illustration of the mechanism shown in FIG. 3.

Connected and rotatable by the gimbal assembly 56 is a gear 74 which mates with a gear 76, supported for rotation on axis 78. These components may also be generally seen in the perspective view of FIG. 3, looking upward at the gimbal and steering assemblies, and in FIG. 4, a schematic illustration of the mechanism being described. Integrally connected to gear 76 is an arm 80 having a pin 82 thereon, fitting within a mating slot 84 (see FIGS. 3 and 4 particularly) in arm 86 connected to the steering post 52 (see FIG. 2), controlling the front wheel. As illustrated in FIG. 4, the interconnection of elements just described causes the rotation of the steering post 52, and thus the steering of the front wheel, in the same direction as the rotation of the gimbal assembly 56. Preferably the interconnection just described between the rotational gimbal assembly and the front wheel steering should be a free (non binding and relatively low friction) coupling, though the same should also preferably have a minimum looseness, or slop, so that the gimbal assembly and front wheel will move substantially in unison. Also visible in FIG. 2 is the circuit board 88 containing the radio receiver, control signals, decoder and motor drivers, and a plurality of batteries 90 housed in the lower part of the chassis within the battery case 92. The batteries, being relatively heavy, are preferably kept relatively low in the toy, thereby lowering the center of gravity of the toy to make the stability thereof easier to achieve.

Having now described the basic components of the radio-controlled toy motorcycle of the present invention and the general inter cooperation thereof, the actual operation and control of the motorcycle will now be described. Obviously, the radio control of power to the rear wheel drive motor 30 controls the rate of rotation of the rear wheel 34, and thus the speed of the motorcycle. When operating, the flywheel-like members 66 rotate in the direction of the arrow shown both in FIGS. 2 and 3, the flywheel-like members rotating in the same general direction as the wheels of the toy motorcycle, though of course normally operating at a substantially higher angular velocity. When the motorcycle is proceeding straight ahead, any tendency of the motorcycle to lean to either side will cause the flywheel-like members to precess, rotating the gimbal in a direction to steer the motorcycle in the direction of the leaning. This, in essence, steers the motorcycle to drive the wheels thereof back under the center of gravity of the toy motorcycle, thereby eliminating the lean (the center of gravity of the motorcycle of course preferably being in the plane of the front and rear wheels of the motorcycle when the front wheel is pointing straight ahead).

To turn right, the remote control is used to turn on motor 68 to torque the gimbal assembly 56 to rotate the same to initially turn the front wheel of the motorcycle to the left (shown in phantom in FIG. 4). This has the effect of moving the wheels of the toy motorcycle to the left of the center of gravity, effectively creating a lean to the right. The characteristics of the motorcycle in a turn depend on the selection of the relevant parameters used, such as the gyro wheel momentum, the weight of the motorcycle and the height of the center of gravity of the motorcycle, the amount of caster of the front wheel and the torque applied in the turn, if any. As the motorcycle and the gyro lean into the turn, a correcting torque is generated by the gyro and caster of the front wheel. Once in a turn, the gyro will stabilize the motorcycle at whatever steering radius the motorcycle is in. With one selection of parameters, the motorcycle will stabilize in the turn so long as the steering torque is applied, and automatically right itself when the steering torque is removed. With another selection of parameters, the motorcycle will stabilize in a turn after the steering torque has been applied to establish the turn and then removed. In this case, applying torque to the gyro again will either straighten the motorcycle to terminate the turn, or will cause the motorcycle to lean further into the turn, depending upon the direction of the torque provided. In either case, increasing the speed of the motorcycle will increase the turning radius and decreasing the speed will decrease the turning radius.

The characteristics of the motorcycle in a turn may be changed, by way of example, just by changing the velocity of the flywheel-like member. In a preferred embodiment, the parameters are selected so that the motorcycle will generally stay in the turn after the steering torque is removed, though over time will slowly right itself, defining a motorcycle path of motion spiraling out to a straight line. This has been found to provide good stability to the motorcycle both when in a turn and when traveling straight ahead, and allows the on-off characteristics of the steering motor to increase or decrease a turn as desired. It also avoids the normal variation of parameters causing the motorcycle to spiral into a tighter and tighter turn after removal of the steering torque. Such a selection of parameters is preferably avoided, as the motorcycle then not only becomes unstable in a turn, but would be expected to be unstable when traveling straight ahead, starting a spiraling turn on the occurrence of any directional perturbation when operated on a surface of any roughness.

The net result of the foregoing description is a radio-controlled toy motorcycle which is particularly stable, whether proceeding straight ahead or turning to the left or right and which, like real motorcycles, can make much sharper turns at low speed than at high speed. Prototypes of the present invention exhibit sufficient stability so as to be readily operable on surfaces which are not particularly smooth, such as dirt paths, asphalt surfaces having some small, loose gravel, etc., and even exhibiting sufficient stability to go over jumps and the like without falling over.

As an alternative to the foregoing, the steering motor 68, gear train 70 and slip clutch 72 may be replaced if desired by some form of proportional torquing device, such as by way of example, a DC torquer of the general type used in the instrumentation field. Such a torquer will apply a torque to the gimbal assembly 56 in the direction of, and directly proportional to, the polarity and the magnitude, respectively, of the DC voltage applied to the torquer. Such a torquer arrangement, as well as others one might choose to use, would allow proportional steering through the appropriate proportional radio control signal (channel of a multiple control channel signal), thereby allowing gentle, low speed turns as well as faster higher speed turns.

While the present invention has been disclosed and described with respect to certain preferred embodiments thereof, it will be understood to those skilled in the art that the present invention may be varied without departing from the spirit and scope thereof.

What is claimed is:

1. A toy motorcycle responsive to steering commands to steer the motorcycle in a commanded left turn or right turn steering direction comprising:

a rear wheel having a nonsteerable axis of rotation substantially perpendicular to a fore and aft orientation of the motorcycle and a drive system for causing rotation of the rear wheel;

a front wheel supported for rotation on a steering post, the steering post being rotatable to cause the axis of rotation of the front wheel to swing to either side of a position wherein the axis of the front wheel is substantially parallel to the axis of the rear wheel, the steering post being inclined in an aft direction with respect to vertical to tend to turn the front wheel in the direction the motorcycle is leaning to encourage the motorcycle toward an upright position when in motion;

a gyro wheel and gyro wheel drive motor mounted in a gimbal having a substantially vertical axis, the gimbal being rotatable about the vertical axis to cause the axis of rotation of the gyro wheel to swing to either side of a position wherein the axis of the gyro wheel is parallel to the axis of the rear wheel, the gyro wheel drive motor rotating the gyro wheel in the same direction as the rear wheel of the motorcycle;

the gimbal being coupled to the steering post to rotate the steering post in the same direction as the gimbal; and, a torquing device controllably torquing the gimbal in accordance with the motorcycle steering commands and in a direction to initially turn the front wheel of the motorcycle in a direction opposite to the commanded steering direction, the configuration of said front wheel and said steering post in combination with the gyro wheel thereafter providing a natural stability for the toy motorcycle in the turn when the toy motorcycle is in motion.

2. The toy motorcycle of claim 1 wherein the gyro wheel rotates at a predetermined speed so that the motorcycle will automatically come out of a turn to proceed in a straight line when the torquing device is turned off.

3. The toy motorcycle of claim 1 wherein the gyro wheel rotates at a predetermined speed so that the motorcycle, when in a turn, will generally continue in the turn when the torquing device is turned off.

4. The toy motorcycle of claim 1 wherein the gyro wheel rotates at a predetermined speed so that the motorcycle, when in a turn, will generally continue in the turn when the torquing device is turned off, slowly spiraling with an increasing radius of curvature toward a straight forward path.

5. The toy motorcycle of claim 1 wherein the torquing device comprises a motor and a slip clutch.

6. The toy motorcycle of claim 1 wherein the torquing device comprises a motor and a centrifugal slip clutch.

7. The toy motorcycle of claim 1 further comprising a battery power source and a radio receiver, the radio receiver controlling the battery power to the rear wheel drive system to control speed of the toy motorcycle, and controlling the torquing device to steer the toy motorcycle.

8. The toy motorcycle of claim 1 wherein the steering post is inclined in an aft direction with respect to vertical approximately 17 to 20 degrees.

9. A two wheeled toy responsive to steering commands to steer the toy in a commanded left turn or right turn steering direction comprising:

a chassis;

a rear wheel supported by the chassis and having a nonsteerable axis of rotation and a drive system for causing rotation of the rear wheel;

a front wheel supported for rotation on a steering member, the steering member being supported on the chassis and being rotatable to cause the axis of rotation of the front wheel to swing to either side of a position wherein the axis of the front wheel is parallel to the axis of the rear wheel, the steering member being inclined in an aft direction with respect to vertical to tend to turn the front wheel in the direction the toy is leaning to encourage the toy toward an upright position when in motion;

a gyro wheel and gyro wheel drive motor mounted in a gimbal having a substantially vertical axis, the gimbal being supported in the chassis and rotatable about the vertical axis to cause the axis of rotation of the gyro wheel to swing to either side of a position wherein the axis of the gyro wheel is substantially parallel to the axis of the rear wheel, the gyro wheel drive motor rotating the gyro wheel in the same direction as the rear wheel of the toy;

the gimbal being coupled to the steering member to rotate the steering member in the same direction as the gimbal; and, a torquing device mounted in the chassis and controllably torquing the gimbal in accordance with the steering commands and in a direction to initially turn the front wheel of the toy in a direction opposite to the commanded steering direction, the configuration of said front wheel and said steering member in combination with the gyro wheel thereafter providing a natural stability for the toy in the turn when the toy is in motion.

10. The two wheeled toy of claim 9 wherein the gyro wheel rotates at a predetermined speed so that the toy will automatically come out of a turn to proceed in a straight line when the torquing device is turned off.

11. The two wheeled toy of claim 9 wherein the gyro wheel rotates at a predetermined speed so that the toy, when in a turn, will generally continue in the turn when the torquing device is turned off.

12. The two wheeled toy of claim 9 wherein the gyro wheel rotates at a predetermined speed so that the toy, when in a turn, will generally continue in the turn when the torquing device is turned off, slowly spiraling with an increasing radius of curvature toward a straight forward path.

13. The two wheeled toy of claim 9 wherein the torquing device comprises a motor and a slip clutch.

14. The toy of claim 9 wherein the torquing device comprises a motor and a centrifugal slip clutch.

15. The toy of claim 9 further comprising a battery power source and a radio receiver mounted in the chassis, the radio receiver controlling the battery power to the rear wheel drive system to control speed of the toy, and controlling the torquing device to steer the toy.

16. The toy of claim 9 wherein the steering post is inclined in an aft direction with respect to vertical in the range of approximately 17 to 20 degrees.

17. The toy of claim 9 wherein the rear wheel is supported by the chassis through a rear wheel suspension spring mounted to the chassis, and wherein the rear wheel drive system includes a motor mounted to the chassis.

18. A method of stabilizing and steering a toy having a rear wheel and a steerable front wheel castered to tend to automatically steer in the direction the toy leans, the toy being responsive to steering commands to steer the toy in a commanded left turn or right turn steering direction, comprising the steps of:

providing a spinning gyro wheel in a gimbal having a substantially vertical axis, the gimbal being rotatable about the vertical axis to cause the axis of rotation of the gyro wheel to swing to either side of a position wherein the axis of the gyro wheel is substantially parallel to the axis of the rear wheel, the gyro wheel spinning in the same direction as the rear wheel of the toy;

directly coupling the gimbal to the steerable front wheel to steer the front wheel in the same direction as the gimbal rotates; and, torquing the gimbal in accordance with steering commands and in a direction to initially turn the front wheel of the toy in a direction opposite to the commanded steering direction, the caster of said steerable front wheel in combination with the gyro wheel thereafter providing a natural stability for the toy in the turn when the toy is in motion.

19. The method of claim 18 wherein the gimbal is torqued by a motor driving a centrifugal slip clutch.

20. A stabilizing and steering system in combination with a toy having a rear wheel and a steerable front wheel castered to tend to automatically steer in the direction the toy leans, the toy being responsive to steering commands to steer the toy in a commanded left turn or right turn steering direction, said stabilizing and steering system comprising:

a spinable gyro wheel in a gimbal having a substantially vertical axis, the gimbal being rotatable about the vertical axis to cause the axis of rotation of the gyro wheel to swing to either side of a position wherein the axis of the gyro wheel is substantially parallel to the axis of the rear wheel, the gyro wheel spinning in the same direction as the rear wheel of the toy;

the gimbal being coupled to the steerable front wheel to steer the front wheel in the same direction as the gimbal rotates; and, a torquing device for torquing the gimbal in accordance with steering commands and in a direction to initially turn the front wheel of the toy in a direction opposite to the commanded steering direction, the caster of said steerable front wheel in combination with the gyro wheel thereafter providing a natural stability for the toy in the turn when the toy is in motion.

21. A two wheeled toy, the toy being responsive to steering commands to steer the toy in a commanded left turn or right turn steering direction, comprising:

a chassis;

a rear wheel supported by the chassis and having a nonsteerable axis of rotation and a drive system for causing rotation of the rear wheel, the rear wheel being supported by the chassis through a rear wheel suspension spring mounted to the chassis, and wherein the rear wheel drive system includes a motor mounted to the chassis;

a front wheel supported for rotation on a steering member, the steering member being supported on the chassis for rotation about an axis inclined in an aft direction with respect to vertical to tend to turn the front wheel in the direction of the toy is leaning to encourage the toy toward an upright position when in motion, the steering member being rotatable to cause the axis of rotation of the front wheel to swing to either side of a position wherein the axis of the front wheel is parallel to the axis of the rear wheel;

a gyro wheel and gyro wheel drive motor mounted in a gimbal having a substantially vertical axis, the gimbal being supported in the chassis and rotatable about the vertical axis to cause the axis of rotation of the gyro wheel to swing to either side of a position wherein the axis of the gyro wheel is substantially parallel to the axis of the rear wheel, the gyro wheel spinning in the same direction as the rear wheel of the toy;

the gimbal being coupled to the steering post to rotate the steering post in the same direction as the gimbal; and, a motor and a slip clutch mounted in the chassis and controllably torquing the gimbal in accordance with steering commands and in a direction to initially turn the front wheel of the toy in a direction opposite to the commanded steering direction, the configuration of said front wheel and said steering member in combination with the gyro wheel thereafter providing a natural stability for the motorcycle in the turn when the motorcycle is in motion; and, a battery power source and a radio receiver mounted in the chassis, the radio receiver controlling the battery power to the rear wheel drive system to control speed of the toy, and controlling the torquing device to steer the toy.

22. The two wheeled toy of claim 21 wherein the gyro wheel rotates at a predetermined speed so that the toy will automatically come out of a turn to proceed in a straight line when the torquing device is turned off.

23. The two wheeled toy of claim 21 wherein the gyro wheel rotates at a Predetermined speed so that the toy, when in a turn, will generally continue in the turn when the torquing device is turned off.

24. The two wheeled toy of claim 21 wherein the gyro wheel rotates at a predetermined speed so that the toy, when in a turn, will generally continue in the turn when the torquing device is turned off, slowly spiraling with an increasing radius of curvature toward a straight forward path.

25. The two wheeled toy of claim 21 wherein the slip clutch is a centrifugal slip clutch.

* * * * *